US006572447B2

(12) United States Patent
Veik et al.

(10) Patent No.: US 6,572,447 B2
(45) Date of Patent: Jun. 3, 2003

(54) METHOD OF FORMING A BASE BODY FOR A DIAMOND BIT

(75) Inventors: Günther Veik, Mäder (AT); Achim Ruf, Feldkirch (AT); Christoph Laumen, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/933,969

(22) Filed: Aug. 21, 2001

(65) Prior Publication Data

US 2002/0023635 A1 Feb. 28, 2002

(30) Foreign Application Priority Data

Aug. 25, 2000 (DE) ..... 100 41 911

(51) Int. Cl.[7] ..... B24B 1/00

(52) U.S. Cl. ..... 451/28; 451/49; 29/890.43; 29/890.53; 72/82

(58) Field of Search ..... 451/28, 49; 29/890.043, 29/890.053, 890.13, 874, 882, 330, 747; 72/82, 83

(56) References Cited

U.S. PATENT DOCUMENTS

| | | | | |
|---|---|---|---|---|
| 4,328,647 A | * | 5/1982 | Gillette et al. | 451/470 |
| 5,910,041 A | * | 6/1999 | Duescher | 451/28 |
| 6,108,856 A | * | 8/2000 | Shary et al. | 15/230 |
| 6,283,823 B1 | * | 9/2001 | Mori et al. | 451/424 |

* cited by examiner

*Primary Examiner*—Joseph J. Hail, III
*Assistant Examiner*—Alvin J Grant
(74) *Attorney, Agent, or Firm*—Sidley Austin Brown & Wood, LLP

(57) ABSTRACT

A method of forming a base body for a diamond bit having a tubular carrier body (2, 12) with a bottom (4), and a shank (1, 11) projecting from the bottom (1), with the carrier body (2, 12) and the bottom being produced by a spinning process.

8 Claims, 2 Drawing Sheets

METHOD OF FORMING A BASE BODY FOR A DIAMOND BIT

Each of the parts of the base body is produced separately which requires a substantial number of separate technological operations such as machining operations and welding operations. Therefore, the manufacturing costs of producing a base body are rather high. If the parts are produced at separate locations, storage and transportation costs are added to manufacturing costs. A further drawback of the conventional base body is that its concentricity can be altered as result, e.g., of improper handling of the base body during its transportation. Further, the large-diameter carrier bodies can be subjected during their transportation to shocks acting in radial direction which results in the deviation of their cross-section from a circular cross-section.

Further, the tubular carrier body is brought into a final shape primarily by machining which permits obtaining of smooth inner and outer surfaces. However, when, e.g., the diamond cutting element, which is provided at the bore-side end surface of the carrier body, undergoes a sidewise wear, the high friction between the smooth outer surface of the tubular carrier body and the inner wall of the bore adversely affects the quality of the bore surface. A further drawback of the smooth surfaces consists in that they cannot be used for removing drilings from an annular slot produced by the diamond bit.

Accordingly, an object of the present invention is to provide a cost-effective method of forming base bodies for diamond bits.

Another object of the present invention is to provide a method of forming base bodies the carrier body of which is characterized by small weight, small wall thickness, and good concentricity.

A further object of the present invention is to provide a method of forming base bodies the carrier body of which has an outer surface that provides for removal of drillings from formed circular slots.

A still further object of the invention is a base body for a diamond bit which is characterized by a sufficient rigidity so that it is not damaged during transportation.

SUMMARY OF THE INVENTION

These and other objects of the present invention, which will become apparent hereinafter, are achieved by providing a method of forming a base body for a diamond bit and according to which method, first a blank which has a carrier body portion with opposite end surfaces and a shank portion projecting from one of the opposite end surfaces of the carrier body portion, is formed. Then, the blank is placed in a spinning machine-tool, with the shank portion being secured in a main spindle of the spinning machine-tool. A mandrel is pressed against another of the opposite end surfaces of the carrier body portion, and the carrier body, together with the bottom is formed by subjecting the carrier body portion of the blank to a spinning process. The objects of the invention are also achieved by providing a base body the tubular carrier body of which is formed by a spinning process.

The advantage of using the spinning process consists in that it permits to produce a base body formed of the same material and in that only a small number of operation is needed for producing the base body. The latter substantially reduces the manufacturing costs.

The spinning process permits to obtain tubular bodies with a very large length. Because during spinning, the material becomes strain-hardened, very small wall thicknesses can be obtained which correspond to from 0.008 to 0.016 times of the outer diameter of the carrier body. Despite its small wall thickness, the carrier body has a sufficient rigidity necessary for drilling bores. The reduced wall thickness of the carrier body results in a total reduction of weight of the base body, which is particularly important when the diamond bit is used with a hand-held power tool.

Preferably, the produced carried body has a deviation in concentricity of less than 1.3 mm. Such a small concentricity deviation can be obtained only by spinning during which the deformable material is uniformly displaced by press rollers. In addition, the bottom, which is formed as one-piece with the tubular wall of the carrier body, provides for a high radial rigidity so that the tubular carrier body does not become deformed, e.g., as a result, e.g., of improper handling of the tubular carrier body during transportation.

Because the radial extent of the cutting element, which is provided at the bore-side end of the tubular carrier body only slightly exceeds the wall thickness of the carrier body, the increasing wear of the cutting element leads to friction between the outer surface of the carrier body and the wall of the formed bore. This friction results in the heating of the entire base body and to an increased load acting on the drive motor used for driving the diamond bit. By providing a predetermined shaped profile on the inner and/or outer side of the tubular wall of the carrier body, the size of the surface, which contacts the surfaces of the produced circular slot can be significantly reduced. In this way, the friction between the carrier body and the bore surfaces can be substantially reduced. Another advantage of providing of a shaped profile on the tubular body is that the shaped profile can be formed as reinforcing ribs which further increase the rigidity of the tubular carrier body.

Another advantage of providing a shaped profile on the tubular wall of the carrier body, which preferably, has the shape of a helix, is that consists in that it contributes to removal of drillings from the formed circular slot. The carrier body has a wall thickness, in the region of the shaped profile, which corresponds to or almost to 0.03 times of an outer diameter of the carrier body.

Because the at least one diamond cutting element, which is provided or the bore-side, free end of the carrier body, is secured thereto by soldering or welding, a correspondingly large connection area becomes necessary. A large connection area is obtained by increasing the wall thickness of the carrier body radially outwardly towards its bore-side free end. The increase of the wall thickness of the carrier body radially outwardly is effected along a predetermined portion of the entire length of the carrier body. The increase of the wall thickness can be also effected radially inwardly or both radially outwardly and inwardly. When the wall thickness of the carrier body increases only radially inwardly, the inner diameter of the tubular body naturally decreases toward the free end of the tubular body.

The wall thickness of the carrier body, at its bore-side free end, ranges from 0.012 to 0.014 times of the outer diameter of the carrier body measured at the free end. The carrier body has an increased thickness at its free end.

In order to provide for a smooth transition region between the increased thickness section and the regular thickness section of the carrier body and which would not adversely affect the removal of drillings, the increased thickness section extends over a length corresponding to 0.04–0.14 of the entire length of the carrier body.

To provide the carrier body with a particularly high stability, the bottom of the carrier body is formed as a bell bottom. The base member is formed, preferably, of metal that can be deformed by spinning rather easily.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 2:
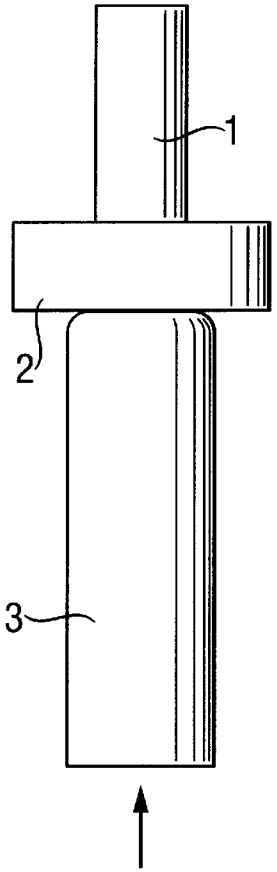
FIG. 2 a front elevational view of the blank shown in FIG. 1 together with a pressing roller mandrel.
Figure 1:
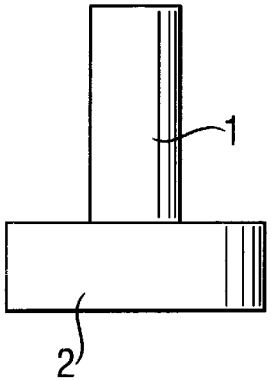
FIG. 1 a front elevational view of a blank from which a base body according to the present invention for a diamond bit is formed.

FIG. 1 shows a machined, cast or forged blank with a non-treated shank portion 1' and a carrier body portion 2'. The blank is placed in a spinning machine-tool (not shown), with the shank portion 1' being secured in a main spindle of the machine-tool. With the main spindle of the spinning machinetool, the blank is brought into contact with a mandrel 3. As shown in FIG. 2, the mandrel 3 has a cylindrical outer profile. The mandrel 3 is pressed against an end surface of the carrier body portion 2' which faces in the bore direction, i.e., in a direction in which the end surface would have faced if positioned in front of a component in which a bore is to be formed.

Figure 3:
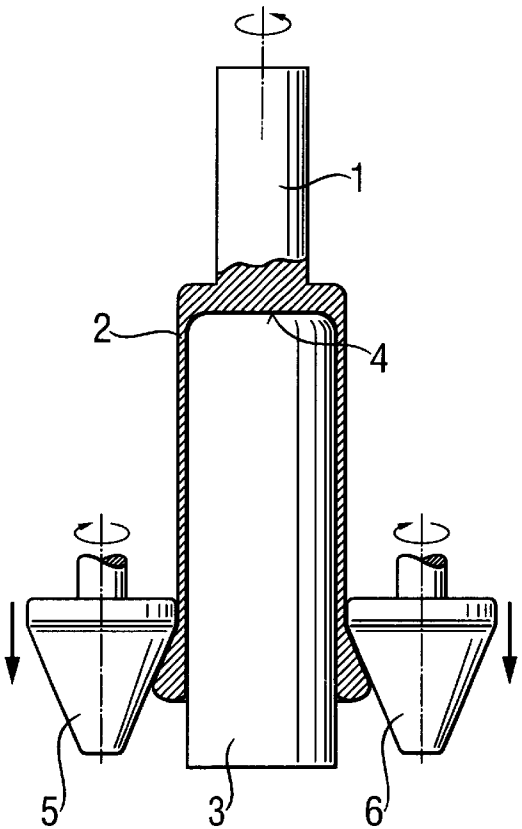
FIG. 3 an elevational, partially cross-sectional view illustrating formation of a tubular carrier body of the blank shown in FIG. 1 with pressing rollers.

The shank is secured in the spinning machine-tool to prevent displacement of the shank in the axial direction and is rotated by the main spindle of the spinning machine-tool. The direction of rotation of the blank is indicated with an arrow in FIG. 3. Two pressing rollers 5 and 6 have a conical shape, tapering in the bore direction, as is also shown in FIG. 3. The pressing rollers 5 and 6 are displaced axially along the mandrel 3 as shown by straight arrows, while simultaneously being rotated in a direction opposite the rotational direction of the blank. As a result of pressure applied by the rollers 5 and 6, the material of the carrier body portion 2' is plastically deformed while being simultaneously partially displaced along the mandrel 3. As a result, the carrier body portion 2' assumes a tubular shape. As a result of the predetermined movement of the rollers 5 and 6, the portion of the blank, which forms the carrier body 2, is reduced to a predetermined wall thickness and is brought to a predetermined length.

Upon displacement of the rollers 5 and 6 in the bore direction, the mandrel 3 is displaced in the opposite direction. The displacement of the mandrel 3 in the direction opposite the bore direction causes a portion of a material, of which the carrier body 2 is formed, to displace sidewise, forming a bottom 4 the thickness of which exceeds the wall thickness of the tubular section of the carrier body 2. The wall thickness of the tubular section, which is formed by the spinning process, can amount to from 0.7 mm to 2.5 mm, in particular, to 1.7 mm. The tubular section has a deviation from concentricity of at the most 1.1 mm. The thickness of the bottom 4 amounts to about 10 mm. The spinning process permits the obtaining of tubular bodies having a length ranging from 20 to about 500 mm.

The thickness of the wall of the tubular section of the carrier body 2 increases toward the bore-side end of the tubular section in order to provide for a reliable mounting of a diamond cutting element (not shown). The increased diameter portion or the widened portion 8 of the tubular section is obtained by fully widening the outer profile of the tubular section at the bore-side end. The length of the widened portion 8 in a direction parallel to the longitudinal extent of the tubular section corresponds to from about 0.04 to about 0.14 of the entire length of the carrier body 2. The wall thickness of the carrier body 2 at the bore-side, free end of the tubular section amounts to from about 1.5 mm to 3.5 mm. The bottom of the carrier body has a shape of a bell.

Figure 4:
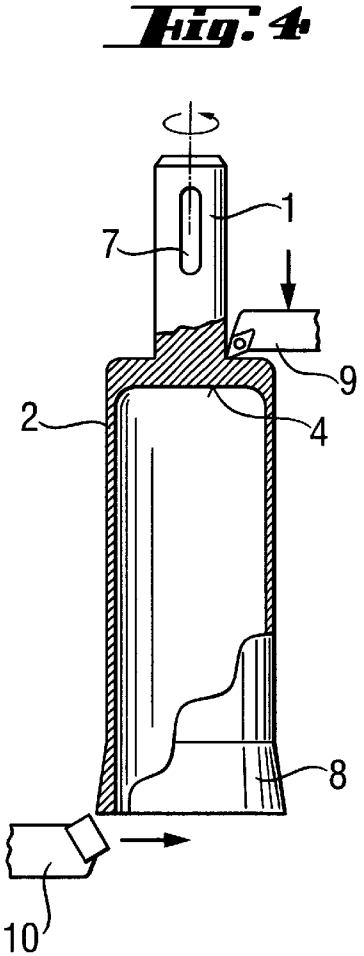
FIG. 4 an elevational view illustrating machining of the shank and a bore-side end of the carrier body.

A longitudinal groove 7 in the shank 1 is machined by a cutter 9, and the free, bore-side end of the tubular section of the carrier body 2 is finished by a cutter 10, as shown in FIG. 4.

Figure 5:
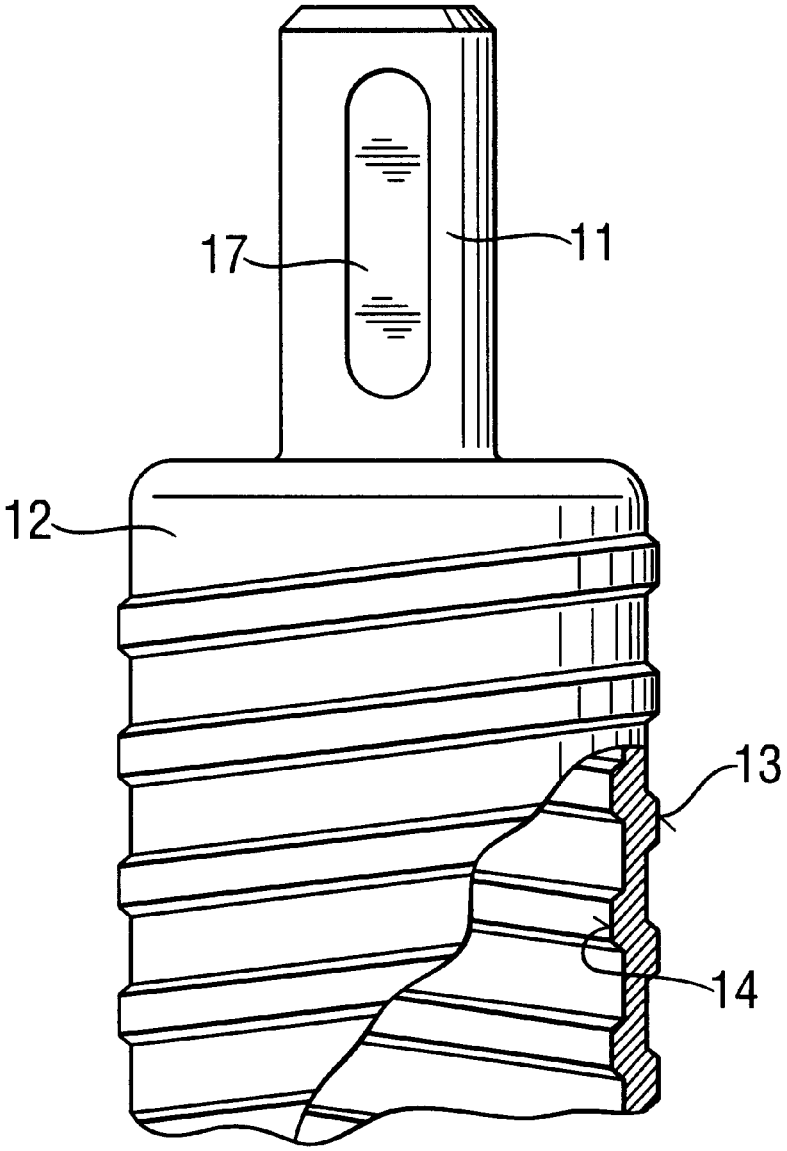
FIG. 5 a partially cross-sectional, front elevational view of another embodiment of a base body according to the present invention the carrier body of which is provided with a predetermined profile.

FIG. 5 shows a base body having a shank 11 and a carrier body 12. The shank 11 has a closed groove 17. The inner and outer sides of the carrier body 12 are provided with a shaped profile formed as a trapezoidal thread.

Though the present invention was shown and described with references to the preferred embodiments, such are merely illustrative of the present invention and are not to be construed as a limitation thereof, and various modifications of the present invention will be apparent to those skilled in the art. It is, therefore not intended that the present invention be limited to the body 2 at the bore-side, free end of the tubular section amounts to from about 1.5 mm to 3.5 mm. The bottom of the carrier body has a shape of a bell.

A longitudinal groove 7 in the shank 1 is machined by a cutter 9, and the free, bore-side end of the tubular section of the carrier body 2 is finished by a cutter 10, as shown in FIG. 4.

FIG. 5 shows a base body having a shank 11 and a carrier body 12. The shank 11 has a closed groove 17. The inner and outer sides of the carrier body 12 are provided with a shaped profile, e.g., of a trapezoidal thread.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A method forming a base body for a diamond bit, the base body having a tubular carrier body (2, 12) having a bottom (4), and a shank (1, 11) projecting from the bottom (4), the method comprising the steps of providing a blank having a carrier body portion (2') having opposite end surfaces, and a shank portion (1') projecting from one of the opposite end surfaces of the carrier body portion; placing the blank in a spinning machine-tool, with the shank portion being secured in a main spindle of the spinning machine-tool; pressing a mandrel against another of the opposite end surfaces of the carrier body portion; and forming the tubular carrier body (2,12), together with the bottom (4) by subjecting the carrier body portion (2') of the blank to a spinning process.

2. A method according to claim 1, wherein the step of subjecting the carrier body portion to the spinning process comprises displacing of press rollers of the spinning machine-tool along the mandrel, while rotating the press rollers in a direction opposite to a rotational direction of the blank.

3. A method according to claim 1, wherein the forming step includes forming a carrier body with a wall thickness corresponding to from 0.008 to 0.016 times of an outer diameter of the carrier body (2, 12).

4. A method according to claim 1, wherein the forming step includes forming a carrier body (2, 12) having a deviation from concentricity less than 1.3 mm.

5. A method according to claim 1, further comprising the step of providing a shaped profile on at least one of outer and inner surfaces of the carrier body (12).

6. A method according to claim 5, wherein the shaped profile is formed as a helical profile.

7. A method according to claim 1, wherein the forming step comprises forming a tubular carrier body having an increased wall thickness at a bore-side, free end thereof.

8. A method according to claim 7, wherein a portion of the tubular carrier body with an increased wall thickness has a length corresponding to from 0.04 to 0.14 times of a total length of the carrier body.

* * * * *